US010913646B2

(12) United States Patent
Clüsserath

(10) Patent No.: US 10,913,646 B2
(45) Date of Patent: Feb. 9, 2021

(54) METHOD FOR FILLING CONTAINERS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 213 days.

(21) Appl. No.: 16/303,791

(22) PCT Filed: Jun. 19, 2017

(86) PCT No.: PCT/EP2017/064928
§ 371 (c)(1),
(2) Date: Nov. 21, 2018

(87) PCT Pub. No.: WO2018/007137
PCT Pub. Date: Jan. 11, 2018

(65) Prior Publication Data

US 2020/0317495 A1 Oct. 8, 2020

(30) Foreign Application Priority Data

Jul. 6, 2016 (DE) ..... 10 2016 112 369

(51) Int. Cl.
*B67C 3/28* (2006.01)
*B67C 3/00* (2006.01)

(52) U.S. Cl.
CPC ..... *B67C 3/284* (2013.01); *B67C 3/007* (2013.01)

(58) Field of Classification Search
CPC ..... B67C 3/284; B67C 3/007
See application file for complete search history.

(56) References Cited

U.S. PATENT DOCUMENTS 5,538,054 A * 7/1996 L uhmann et al. ..... B67C 3/007 141/198
2008/0271809 A1* 11/2008 Goldman ..... B67D 1/0044 141/9

FOREIGN PATENT DOCUMENTS

| | | |
|---|---|---|
| DE | 42 39 954 | 6/1994 |
| DE | 43 06 120 | 7/1994 |
| DE | 44 46 548 | 6/1996 |
| EP | 0 613 854 | 9/1994 |

* cited by examiner

*Primary Examiner* — Jason K Niesz
(74) *Attorney, Agent, or Firm* — Occhiuti & Rohlicek LLP

(57) ABSTRACT

A filling method includes adjusting a start of a filling phase on a filling machine so that the container completes filling within a detection region at which an optical sensor is able to inspect the container to determine the actual fill-level and to send a signal to a controller to cause the container to be topped off if need be.

18 Claims, 3 Drawing Sheets

METHOD FOR FILLING CONTAINERS

RELATED APPLICATIONS

This is the national stage under 35 USC 371 of international application PCT/EP2017/064928, filed on Jun. 19, 2017, which claims the benefit of the Jul. 6, 2016 priority date of German application DE102016112369.2, the contents of which are herein incorporated by reference.

FIELD OF INVENTION

The invention relates to mass production of filled containers, and in particular, to the filling process.

BACKGROUND

Filling machines are used for mass production of containers that are filled with a liquid filler. These filling machines are expected to fill each container with the same amount of liquid filler.

A difficulty that arises is that there exist manufacturing variations in containers. This affects the correct fill level in the container. It is therefore desirable for filling machines to be able to control fill level with precision. One way to do this is to have a feedback system that inspects a fill level and controls filling based on the result of that inspection.

A filling machine usually fills containers while they are moving. For example, in a rotary filling-machine, a container is placed under a filling element at a filling position on a rotor. The rotor then turns. As the rotor turns, the filling element fills the container.

In the interest of efficiency, one does not want to complete one revolution of the rotor without the filling element already having filled the container. If this were to occur, containers might have to stay on the rotor for several rotations before being filled. This would slow down production.

In order to avoid this, it is useful to drive the rotor at a speed that ensures that the container is filled before one revolution has elapsed.

SUMMARY

The invention provides a way to reliably detect fill level even when a filling machine is being run at different throughputs.

In one aspect, the invention features a method for filling containers with liquid fill using a filling machine having a plurality of filling positions, each of which has a filling element with at least one filling valve. The filling position receives a container and the filling machine's conveyor moves it at an adjustable conveying speed in a transport direction along a filling path between an inlet and an outlet.

During a filling phase, the filling element fills the container with liquid fill at some flow rate, which can be constant or regulated. This involves opening a valve of that filling element somewhere between the inlet and the outlet.

Eventually, the container reaches a spatially-fixed detection region at which a spatially-fixed sensor optically inspects the container to collect data that indicates the level to which it has been filled, referred to as the "fill level." A controller then adjusts the start of the filling phase depending on how close this fill level is to a desired fill level. Regardless of the filling machine's capacity and its operation, the filling phase always ends in the detection region.

The start of the filling phase can be viewed temporally, as the time at which filling begins, or spatially, as the position of the container at the time that filling begins.

When the filling machine operates at its maximum conveying speed, the controller starts the filling phase as soon as the container reaches the inlet. Otherwise, the controller delays the start of the filling phase by a defined wait during which the container reaches a point that is closer to the outlet. Only then does the controller start the filling phase. In particular, when the filling machine operates at its minimum conveying speed, the controller delays the start of the filling phase by a maximum wait.

In some practices, the controller also starts the filling phase based on the volumetric flow rate of liquid fill.

Other practices include starting the filling phase based at least in part on a pressure curve associated with a container. The pressure curve shows pressure as a function of time. In some practices, the pressure curve shows a flushing and/or evacuation phase that occurs upstream of the filling phase in space and before the filling phase in time. In other practices, the pressure curve shows a relaxation phase that is downstream from the filling phase in space and after the filling phase in time.

Other practices of the invention features adjusting the starting time based on how much liquid filler flows into a container per unit time.

Other practices include having another sensor that is upstream of the rotor so that it can inspect containers before the containers are even loaded into a filling position. This sensor collects data indicative of the container's geometry and/or size. In such practices, the controller uses the data to adjust the start of the filling phase.

Yet other practices feature detecting an actual fill-level and comparing it to a desired fill-level. Upon detecting a deviation between the two, and in particular, upon detecting that the former is lower than the latter, the controller causes the filling element to top up the container so that the fill level reaches the desired fill-level.

Some practices include having the first sensor simultaneously inspect fill levels of two or more containers that are present in the detection region at the same time. Among these are practices in which the first sensor inspects the containers concurrently.

In yet other practices, the sensor obtains image data concerning the fill level while the container is in the detection region.

Further embodiments, advantages, and possible applications of the invention also derive from the following description of exemplary embodiments and from the figures. In this situation, all the features described and/or pictorially represented are in principle objects of the invention, alone or in any desired combination, regardless of their combination in the claims or reference to them. The contents of the claims are also considered a constituent part of the description.

BRIEF DESCRIPTION OF THE DRAWINGS

The invention is described in greater detail hereinafter by reference to the figures related to an exemplary embodiment. The figures show.

DETAILED DESCRIPTION

Figure 1:
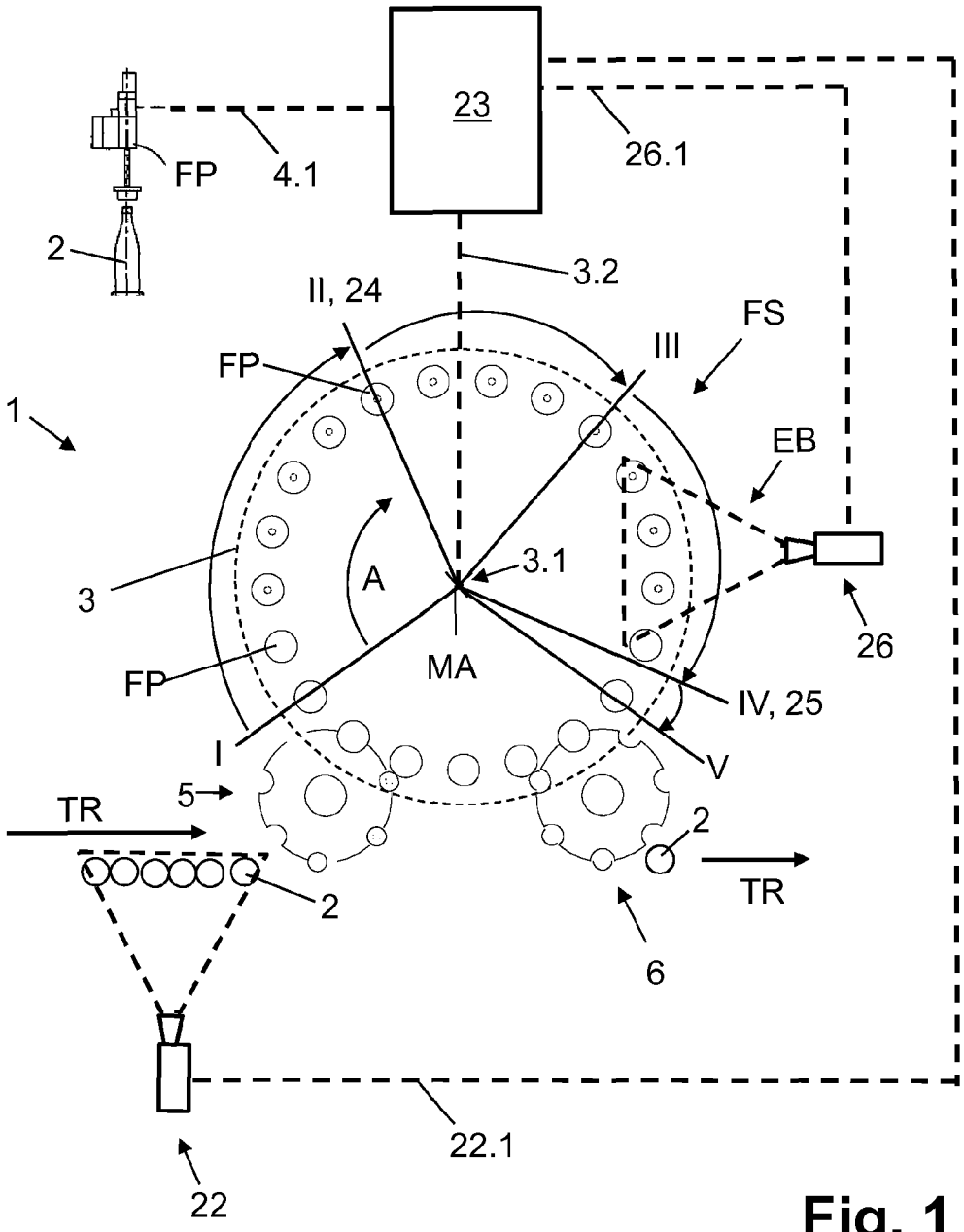
FIG. 1 shows a filing machine from above.

FIG. 1 shows a filling machine 1 for free-jet filling of containers 2 with liquid filler using a filling pressure that deviates from ambient pressure. A ring bowl 30, shown in FIG. 2, holds the liquid filler.

Examples of containers 2 include PET bottles and glass bottles that are formed from a material that is transparent to light. Examples of liquid filler include beer, soft drinks, and other beverages that contain carbonic acid. Although the illustrated filling machine 1 is a rotating machine, principles described herein are equally applicable to other filling-machine topologies, such as that used in a linear filling-machine.

The filling machine 1 features a controllable drive 3.1 that rotates a rotor 3 around a vertical machine-axis MA at an adjustable conveying speed and along a rotation direction A. A control line 3.2 connects the drive 3.1 to a control-and-evaluation device 23, hereafter referred to as a "controller," that controls or regulates the drive 3.1.

A conveying path 5.1 conveys containers 2 towards an inlet star 5 along a transport direction TR. The container inlet 5 conveys these containers 2 to filling positions FP that are disposed around the periphery of the rotor 3. As they traverse the conveying path 5.1, the containers 2 are spaced apart at a predetermined interval that corresponds to the space between the filling positions FP and also to the space between pockets of the inlet star 5.

After being filled, the containers 2 proceed out through an outlet star 6. The actual filling operation takes place within a range of angles through which the rotor 3 carries a container 2. The details of the filling process as described below are applicable to both a rotary filling-machine 1 and a linear filling-machine. The main difference is that in a rotary filling-machine 1, the regions in question correspond to ranges of angles instead of ranges in linear position.

Figure 2:
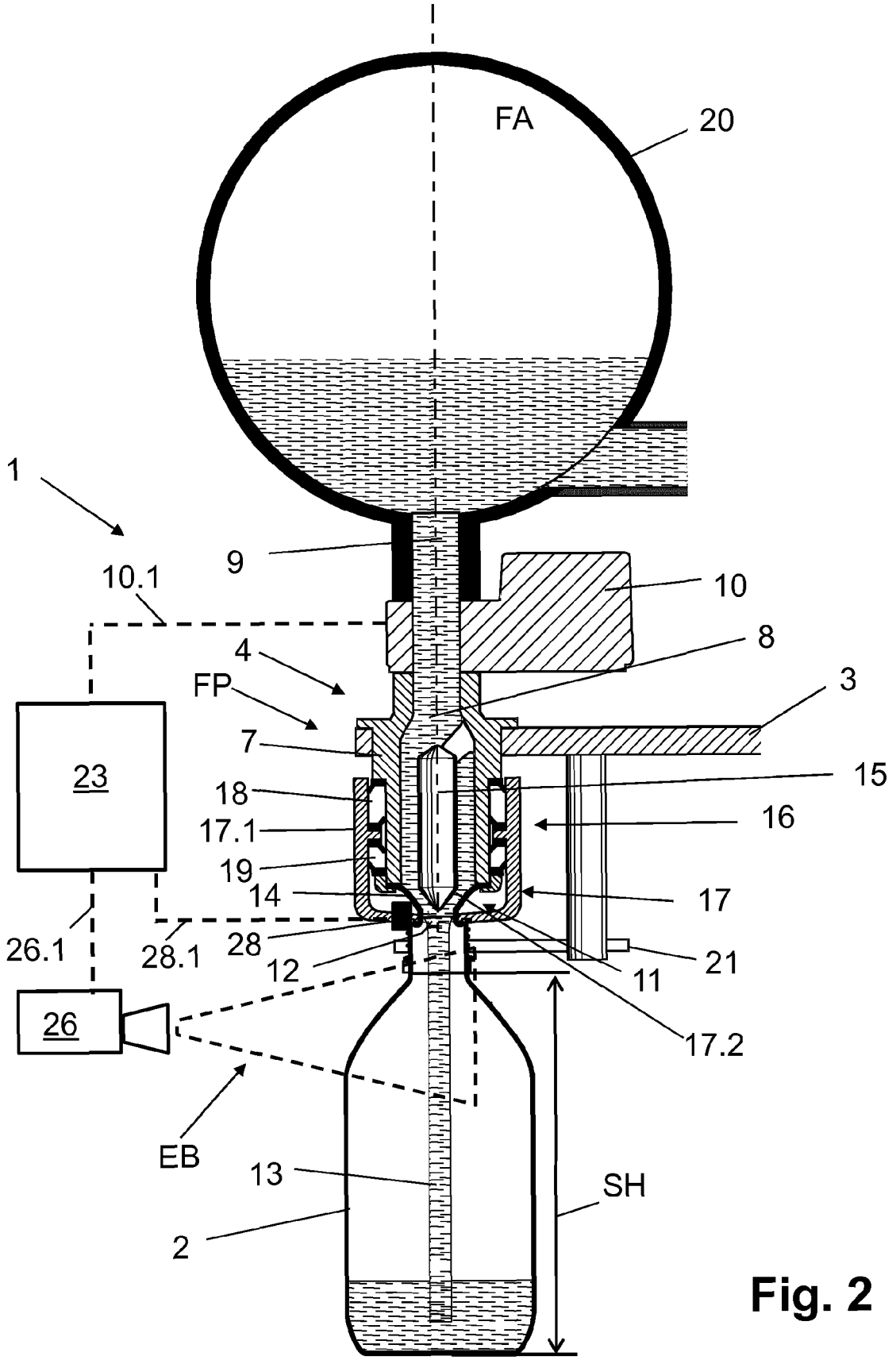
FIG. 2 shows a sectional view of a filling element from the filling machine shown in FIG. 1.

Referring now to FIG. 2, each filling position FP has a filling element 4 that has a valve 11 that opens and closes to control the flow of liquid filler. Each filling element 4 also has a container carrier 21. In the illustrated embodiment, the container carrier 21 is one that suspends containers from a flange or neck ring that lies just below the container's opening. The container carrier 21 and the filling element 4 together define the filling position FP.

A fixed first sensor 22 disposed along the transport direction TR observes the containers 3 as they pass by. As it does so, the first sensor 22 collects data from which one can determine the geometry and/or the size of a container, and therefore its interior volume. The first sensor 22 sends a signal indicative of this data via a signal line 22.1 to the controller 23.

In a typical embodiment, the first sensor 22 is an optical detection device that uses an image of a container 2 as a basis for evaluating the geometry of the container 2. A useful type of optical detection device is a video camera. In some embodiments, the electronic circuitry used for evaluating the image is at the first sensor 22. In other embodiments, this same circuitry is at the controller 23.

Referring back to FIG. 1, the apparatus also includes a second sensor 26 that is arranged to inspect the rotor's periphery but that does not rotate with the rotor 3. The second sensor 26 is along a filling path FS that is between a filling-path inlet 24 and a filling-path outlet 25. In the illustrated embodiment, the second sensor 26 is near the filling-path outlet 25.

The second sensor 26 is an optical sensor that is electrically connected to the controller 23 via a signal line 26.1. In some embodiments, the optical sensor is a video camera.

As shown in FIG. 1, the second sensor 26 covers a detection region EB. The detection region EB is a fixed image-acquisition region. While a container is in the detection region EB, the second sensor 26 determines if the filling level SH if liquid filler is correct. In a preferred embodiment, the detection region EB is arranged to permit inspection of plural containers 2. In some of these embodiments, the second sensor 26 inspects four containers 2.

While a container 2 is at the detection region EB, the second sensor 26 determines an actual fill-level of the container 2 and provides it to the controller 23. The controller 23 compares the actual fill-level with a desired fill-level SH that has been stored in the controller 23. If a deviation exists, the controller 23 transmits a signal via a control line 4.1 to the relevant filling position FP correct the actual fill-level. The signal is one that indicates how much fluid to add. This can be expressed as the duration of the filling process, the volumetric flow rate, or a combination of both. The controller 23 thus actuates each filing element 4 or filling position FP on an individual basis taking into account signals obtained from the first and second sensors 22, 26.

Turning now to FIG. 2, the filling element 4 has a liquid channel 8 formed within its housing 7. A product channel 9 connects the liquid channel 8 to the ring bowl 20. In the illustrated embodiment, the product channel 9 has an axis that is parallel to the vertical filling-element axis FA. A flow meter 10 at the base of the ring bowl 20 provides a measured-flow signal to the controller 23 via a signal line 10.1. In some embodiments, the flow meter 10 is a magnetic induction flow meter.

At the housing's underside, a liquid valve 11 opens and closes to control flow of liquid filler through a dispensing opening 12. When the liquid valve opens 11, a free jet 13 of liquid filler through the opening 12. When the liquid valve 11 closes, the free jet 13 stops.

To open and close, the liquid valve 11 relies in part on the interaction of a funnel-shaped diaphragm 14 and a valve body 15.

The diaphragm 14 is a funnel-shaped structure that is made of a product-compatible elastic material. Examples of a suitable material include an elastomer and PTFE.

The valve body 15 is a rod-shaped valve body having tapered upper and lower ends. The valve body's lower end tapers conically and forms a valve surface 15.2 that interacts with the diaphragm 14. In particular, when the valve 11 closes, the valve surface 15.2 contacts the diaphragm 14.

The valve body 15 extends along the filling-element axis FA. When the valve 11 opens, liquid filler flows around the valve body 15. At the valve body's upper end, a laterally-projecting shoulder 16 engages the filling element housing 7 and holds the valve body 15 so that it remains stationary relative to the channel 8.

The liquid valve 11 described is only one embodiment of a free-jet filling system for which the filling level measurement can be used. Other kinds of liquid valves can also be used.

A hollow piston 16 actuates the diaphragm 14. The piston 16 includes a piston body 17 in the form of a cap or bowl. The piston body 17 has a base section 17.2 and a ring section 17.1 above the base section 17.2.

The ring section 17.1 surrounds the housing 7 and the filling-element axis FA, with which it is concentric. It also guides the piston body 17 so that it is displaced along the filling-element axis FA.

The base section defines the dispensing opening 12.

An outer surface of the housing 7 and an inner surface of the ring section 17.1 form walls that define first and second control chambers 18, 19 that are sealed off against each other and against the exterior by seals. The first and second control chambers 18, 19 are offset relative to each other along the machine axis FA. Subjecting the control chambers 18, 19 to a pressure medium, such as compressed air, causes the hollow piston 16 or its piston body 17 to move vertically so as to open or close the liquid valve 11.

A pressure sensor 28 at the piston body 17 measures pressure within a container 2 sealed against the filling element 4. The pressure sensor 28 provides this measurement to the controller 23 via a signal line 28.1.

FIG. 1 shows that a filling position FP traverses five different regions I-V as it travels from the inlet star 5 to the outlet star 6. Each region correspond ds to a range of angles of the rotor 3. Each region corresponds to a different phase of the filling procedure.

In some practices, a flushing phase or pre-tensioning phase is carried out upstream of the actual filling phase. The flushing phase or pre-tensioning phase are carried out before the actual filling phase begins and upstream of the rotor in the transport direction TR. In other practices, a relaxation phase likewise takes place after the filling phase and downstream of the rotor 3 along the transport direction TR.

Position I marks the beginning of the flushing and/or pre-tensioning phase of a container 2 that has been sealed against a filling element 4.

When the rotor 3 runs at its maximum conveying speed, position II marks the end of flushing and/or pre-tensioning phase and defines a filling-path inlet 24 at the start of the actual filling phase along the filling path FS. When the rotor 3 is at its minimum conveying speed, position II forms the beginning of a wait between the flushing and/or pre-tensioning and the starting time of the actual filling phase along the filling path FS. In this case, it is position III that marks the start of the actual filling operation and the end of the wait.

Position IV marks the end of the filling phase regardless of the rotor's conveying speed. This occurs within the second sensor device's detection region EB. At this point, the containers, which now have been filled, began their relaxation to atmospheric pressure. This relaxation period ends at position V. In operation, a container 2 is taken up at a corresponding filling position FP and moved in the transport direction TR along a filling path FS between a filling path inlet 24 and a filling path outlet 25 at an adjustable conveying speed.

At the start of the filling operation, while the container is somewhere along the filling path FS between the filling path inlet 24 and the filling path outlet 25, the liquid valve 11 opens. This causes liquid filler to enter the container 2 either at a constant volumetric flow rate or at a controlled or regulated rate. The start of the filling operation, which can be viewed as the time filling starts or the location of the container at the time filling starts, is adjustable.

Meanwhile, the second sensor 26 monitors the container's fill level as it moves along the filling path FS. The liquid valve 11 remains open until second sensor determines that the filling level has reached the desired filling level SH. Once it does so, the liquid valve 11 closes. The start of the filling phase is adjusted such that, given the conveying speed and volumetric flow rate, the desired fill-level SH is reached while the container is within the second sensor's detection region EB.

An important feature of the filling machine 1 is that the point at which filling begins can be varied to suit the circumstances. It is no longer the case that the filling procedure has to begin only when the container 2 reaches a particular angle along its path. Instead, the point at which filling begins is adjusted based at least in part on the speed of the rotor 3 in such a way that the container 2 reaches its desired fill-level SH while it is in the detection region EB.

This is useful because the rotor 3 can be made to rotate at different speeds depending on a desired throughput in containers per unit time. If the volumetric flow rate remains roughly constant, the angular range traversed by the container 2 as it is being filled will change depending on how fast the rotor 3 rotates.

For example, if the rotor 3 rotates fast, the container 2 will sweep out a large angle while it is being filled. In that case, it would be prudent to begin filling immediately. This will ensure that, by the time the container 2 reaches the detection region EB, it is already almost full. This gives the second sensor 26 an opportunity to inspect the container's actual fill-level near the end of the filling phase and to send the controller 23 that will allow the controller 23 to control the filling element 4 to top up the actual fill-level as needed.

Conversely, if the rotor 3 is moving slowly, it may be prudent to delay the start of filling. Otherwise filling may be completed long before the container 2 reaches the detection region EB. In that case, if the second sensor 26 were to find that the container 2 had been filled incorrectly, it would be too late to do anything about it.

As a result of being able to adjust where filling begins, the container 2 will always be within the detection region EB just before the fill level reaches the desired fill-level. This enables the second sensor 26 to inspect the fill level and send a signal that ultimately causes the liquid valve 11 to close at the correct instant.

The angular extent required for filling depends not only on the rotor's rotation speed but also on the volumetric flow rate at which liquid fill enters a container 2. Therefore, some embodiments will adjust the start of the filling phase based on the volumetric flow rate of liquid fill in such a way that the container 2 reaches the detection region EB at about the time it is filled to the desired fill-level SH. Again, this permits the second sensor 26 to determine when the desired fill-level SH has been reached and to cause the valve 11 to close in response.

In some embodiments, when the rotor 3 rotates at a maximum conveying speed, the valve 11 opens at the filling-path inlet 24. Thus, the filling-path inlet 24 at position II marks the start of the filling phase. This results in the container 2 being completely filled to the desired fill-level SH between positions II and IV with the completion of filling occurring while the container 2 is in the detection region EB of the second sensor 26.

In some embodiments, when the rotor 3 operates at a minimum conveying speed, the liquid valve 11 opens only when the container reaches position III. The filling process then lasts from position III to position IV. The start of the filling phase is therefore at position III. This results in the container 2 being completely filled to the desired fill-level SH between positions III and IV with the completion of filling occurring while the container 2 is in the detection region EB of the second sensor 26.

At intermediate conveying velocities, the filling phase will start after a wait has brought the container 2 somewhere between positions II and III with the exact angle being a function of the rotor's speed and the volumetric flow rate of liquid fill into the container 2. At the minimum conveying speed, this wait is long enough for the container to travel between position II and position III.

Figure 3:
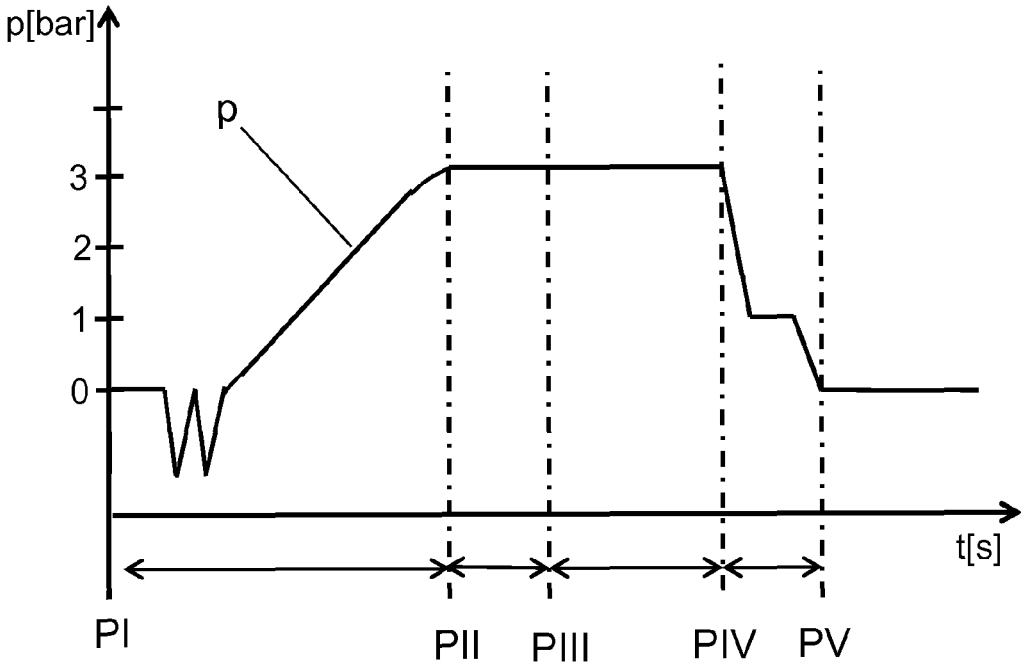
FIG. 3 shows pressure as a function of time during a filling procedure carried out by the filling element shown in FIG. 2.

FIG. 3 shows a result of having the pressure sensor 28 measure pressure p above ambient pressure as a function of time t as the container 2 traverse positions on the rotor 3 as marked in FIG. 1. The positions are marked on the time axis. Time is shown in seconds and pressure is shown in bar. The flushing or evacuation phase comes before the filling phase. A relaxation phase follows the filling phase. The positions II-V can be made to move left or right on the time axis by having the controller 23 vary the rotor's speed in such a way that the filling phase can be completed while the container 2 lies in the detection region EP between positions III and IV.

In the case of non-pressurized container-filling, only the filling phase is necessary. However, the principles described herein are the same. The controller 23 relies on the rotor's speed to ensure that the fill level reaches the desired fill-level SH while the container 2 is in the detection region EB.

In an alternative embodiment, the controller 23 relies instead on the volumetric flow rate as measured by the flow meter 10 to arrive at the same result.

Ultimately, the start of the filling phase is a function of two independent variables, rotor speed and volumetric flow rate, wherein there exists a locus of points in the two-dimensional speed and flow-rate space that would result in the completion of filling while the contained is in the detection region EB. The controller 23 can be programmed to rely on one variable alone or on both variables to determine the correct angle.

In one example, volumetric filling of the container 2 takes place during the filling phase. The valve 11 opens at the start of the filling phase and closes when a predetermined volume of liquid fill has entered the container. The flow meter 10 provides a basis for knowing when the close the valve 11. The second sensor 26 then detects the filling level and sends a signal to the controller 23, which then compares the fill level with a desired fill-level SH stored therein. Based on a deviation between the two, the controller 23 sends an evaluation signal to the relevant filling position FP via the control line 4.1 to cause the filling element 4 to top up the container 2 as needed. In some embodiments, the evaluation signal provides information on how long to top up for or how much volume is needed to top up the container 2.

In determining the correct place to start the filling phase, the controller 23 also relies on the geometry or size of the container. This provides a way to determine the container's volume. The first sensor 22 provides this information to the controller 23 to be used in connection ensuring that filling is completed within the detection region EB, either by moving the start of the filling phase or by adjusting the conveyor's speed or by adjusting the flow rate or any combination thereof.

It is useful to periodically calibrate the filling machine 1. In particular, it is useful to do so when changing containers or changing the liquid fill.

One way to carry out this calibration is to fill containers 2 in the detection region EB without having the rotor 3 move at all. The pressure sensor 28 and/or the flow meter 10 then collect data concerning the progress of the filling phase. This data is then provided to the controller 23 to be used in connection with performance evaluation during filling.

The invention has been described in relation to an exemplary embodiment. It is understood that numerous changes and derivations are possible, without thereby leaving the inventive concept on which the invention is based.

The invention claimed is:

1. A method comprising causing a first container to engage a filling position on a periphery of a rotor that is configured to be driven with an adjustable speed, causing said rotor to move said first container at a first speed along a filling path between a filling-path inlet and a filling-path outlet, adjusting a start of a filling phase such that a desired fill-level of liquid fill in said first container is reached while said first container is within a detection region of a first sensor, said first sensor being an optical sensor, during said filling phase, admitting said liquid fill into said first container at a volumetric flow rate as said first container continues to move toward said detection region, and while said first container is within said detection region, using said first sensor to optically inspect an actual fill-level in said first container to see if said actual fill-level has reached a desired fill-level, wherein adjusting said start of said filling phase comprises adjusting said start based at least in part on a characteristic curve that relates time and pressure in said first container, wherein said method further comprises executing a first phase before said filling phase and a second phase after said filling phase, and wherein said first phase is selected from the group consisting of a flushing phase and a pre-tensioning phase, and wherein said second phase is a relaxation phase.

2. The method of claim 1, further comprising moving said rotor at a maximum conveying speed, wherein adjusting said start comprises causing said filling phase to begin at said filling-path inlet.

3. The method of claim 1, further comprising moving said rotor at a conveying speed that is less than said maximum conveying speed, wherein adjusting said start comprises causing said filling phase to begin after a wait that begins after said first container has passed said filling-path inlet.

4. The method of claim 1, further comprising moving said rotor at a minimum conveying speed, wherein adjusting said start comprises causing said filling phase to begin after a maximum wait that begins after said first container has passed said filling-path inlet.

5. The method of claim 1, wherein adjusting comprises adjusting said start at least in part based on said volumetric flow rate.

6. The method of claim 1, further comprising determining that said actual fill-level is lower than said desired fill-level and topping up said container to reduce a difference between said desired fill-level and said actual fill-level.

7. The method of claim 1, wherein said first container and a second container are both in said detection region at the same time and wherein using said first sensor to optically inspect an actual fill-level comprises using said first sensor to optically inspect actual fill-levels in both said first and second containers concurrently.

8. The method of claim 1, wherein using said first sensor to optically inspect an actual fill-level in said first container comprises obtaining image data indicative of said an actual fill-level.

9. The method of claim 1, further comprising, prior to causing a first container to engage a filling position, calibrating said filling machine, wherein calibrating comprises keeping said rotor stationary while filling containers other than said first container while said containers other than said first container are in said detection region.

10. The method of claim 1, further comprising, while said first container is still upstream of said rotor and moving in a transport direction toward said rotor, using a second sensor to obtain information indicative of size of said first container.

11. The method of claim 1, further comprising selecting said first sensor to be a video camera.

12. The method of claim 1, wherein said detection region is fixed in space.

13. The method of claim 1, inspect actual fill-levels in said first container and also in second, third, and fourth containers, all four of which are present in said detection region.

14. The method of claim 1, further comprising causing said rotor to move a second container along said filling path at a second speed, said second speed being greater than said first speed and causing a filling phase for said second container to start prior to said filling phase for said first container.

15. The method of claim 1, further comprising causing said rotor to move a second container along said filling path at a second speed, said second speed being less than said first speed and causing a filling phase for said second container to start after said filling phase for said first container.

16. The method of claim 1, further comprising following said filling phase with a relaxation phase and preceding said filling phase with a pre-tensioning phase.

17. The method of claim 1, further comprising, while said first container is still upstream of said rotor, while said first container is moving in a transport direction toward said rotor, using a second sensor to obtain information indicative of geometry of said container.

18. The method of claim 17, wherein adjusting comprises adjusting said start based at least in part on said information.

* * * * *